United States Patent [19]

Kamono et al.

[11] Patent Number: 4,973,264

[45] Date of Patent: Nov. 27, 1990

[54] DAISY CHAIN CONNECTOR

[75] Inventors: Takashi Kamono, Yokohama; Akihiko Ohtsu, Kawasaki, both of Japan

[73] Assignee: AMP Incorporated, Harrisburg, Pa.

[21] Appl. No.: 319,939

[22] Filed: Mar. 3, 1989

Related U.S. Application Data

[63] Continuation of Ser. No. 2,525, Jan. 12, 1987, abandoned.

[30] Foreign Application Priority Data

Jan. 27, 1986 [JP] Japan ..... 61-15549
Nov. 17, 1986 [JP] Japan ..... 61-272024

[51] Int. Cl.[5] ..... H01R 3/00

[52] U.S. Cl. ..... 439/498; 439/736; 439/497; 439/874; 29/879

[58] Field of Search ..... 439/874–876, 439/492–499, 92, 507–513, 907, 908, 885, 879, 891, 736; 29/879, 880

[56] References Cited

U.S. PATENT DOCUMENTS

| | | | |
|---|---|---|---|
| 3,238,421 | 3/1966 | Patrick | 439/874 |
| 4,040,704 | 8/1977 | Huber | 439/494 |
| 4,084,872 | 4/1978 | Pritulsky | 439/513 |
| 4,094,564 | 6/1978 | Cacolici | 339/14 L |
| 4,094,566 | 6/1978 | Dola et al. | 339/14 R |
| 4,095,862 | 6/1978 | Hatch . | |
| 4,140,360 | 2/1979 | Huber | 339/176 MF |
| 4,181,384 | 1/1980 | Dola et al. | 339/14 R |
| 4,186,289 | 1/1980 | Ito et al. | 439/874 |
| 4,225,207 | 9/1980 | Brandeau et al. | 439/497 |
| 4,367,909 | 1/1983 | Shatto, Jr. et al. | 439/497 |
| 4,602,831 | 7/1986 | Lockard | 439/880 |

FOREIGN PATENT DOCUMENTS 0023936 2/1981 European Pat. Off. .

*Primary Examiner*—David L. Pirlot
*Attorney, Agent, or Firm*—Adrian J. LaRue

[57] ABSTRACT

Daisy chain connector comprises a dielectric housing in which an electrical contact assembly is secured. Contact assembly comprises identical contact sub-assemblies, each contact sub-assembly including electrical contacts having contact sections in alignment with apertures in a front surface of the housing and terminating legs for electrical connection with signal conductors and ground conductors of electrical cables. Contacts include contact plates in engagement between contact sections and legs defining bifurcated pairs of legs for each contact so that the signal conductors of one of cables are respectively connected to one of legs and the signal conductors of the other of the cables are respectively connected to the other of legs and at least one of legs forms a ground bar to which ground conductors are connected.

14 Claims, 7 Drawing Sheets

DAISY CHAIN CONNECTOR

This application is a Continuation of Application Ser. No. 07/002,525 filed Jan. 12, 1987, now abandoned.

This invention is related to an electrical connector for a cable assembly which is used for data transmission in an apparatus for information processing, such as a computer, and more precisely, a connector which can be used for a daisy chain cable assembly in which a plurality of connectors are connected in series by electrical cables.

BACKGROUND OF THE INVENTION

In an apparatus for information processing, such as a computer, the data being processed in this apparatus must be transmitted between individual parts, and various connection schemes have been used for this purpose. For example, as shown in FIG. 13, connectors 2 are arranged on a mother board 1, and a daughter board 3 having various components arranged thereon is connected to each connector 2, thus, the transmission of data between each daughter board 3 is conducted through the mother board 1. However, a tremendous increase in the volume of data processing has occurred recently because of the higher density of the various components on the daughter boards 3, and this increased volume of data processing cannot be transmitted by the mother board 1 alone.

For the above-mentioned reason, as shown in FIG. 12, a cable assembly 4 is made by mounting connectors 6 onto both ends of a flat cable 5 having a plurality of conductors 5*a*, and this cable assembly 4 is electrically connected to connectors 3*a*, 3*b* which are mounted at the ends of each of the daughter boards 3, as shown in FIG. 13 thereby enabling data to be transmitted by the cable assemblies 4. In this case, when each daughter board 3 is successively connected by the cable assemblies 4, two connectors 3*a*, 3*b* must be mounted on each daughter board respectively, as illustrated, and the problem arises of a decrease in the space on a daughter board for mounting the various components, which is caused by the increase in the number of connectors.

SUMMARY OF THE INVENTION

In composition of the above-mentioned problems, the object of this invention is to provide a connector for a cable assembly which is capable of forming a daisy chain connection by mounting only a single connector on each daughter board.

The connector according to this invention is comprised of a plurality of contacts arranged and retained in a housing, one end of each contact having a first terminal which is electrically engageable with an external terminal of a first external electric circuit board, for example, and the other end having a second terminal to be connected to ends of two different cables connected to second and third external electric circuit boards, for example, and the second terminal includes a pair of bifurcated legs to which terminals of the second and third external electric circuit boards are connected through the first and second cables. Also, one of the bifurcated legs of the second terminal is connected with the first cable of the two different cables which is connected to the second external circuit board and the other of the bifurcated legs is connected to the second cable which is connected to the third external circuit board thus forming a daisy chain connection. Furthermore, the bifurcated legs on one side of selected contacts among the plurality of contacts are connected to the second external electric circuit board through the first cable, and the bifurcated legs on the other side of the remaining contacts among the plurality of contacts are connected to the third external electrical circuit board through the second cable. Thus, the connection between the boards forming electric circuits can be made by mounting the single connector on each board.

BRIEF DESCRIPTION OF THE DRAWINGS

A brief description of the drawings is set forth illustrating by way of example the invention according to the following:

FIGS. 1 and 2 show the daisy chain connector according to this invention. The connector 70 comprises a housing 10 made of a suitable insulating material and includes a pair of upper and lower matable housing sections 12,13, a pair of upper and lower cover sections 14,15, and an electrical contact assembly 40 described later which includes a plurality of contacts 30 and which is retained in the housing 10. Housing sections 12,13 are latchable together whereas cover sections 14,15 are latchable together onto housing sections 12,13. Cover sections 14,15 also provide strain relief for the last flat electrical cables. Each contact 30 of the contact assembly has at one end a receptacle 31 to be connected directly with a terminal of an external electric circuit, and the receptacles are arranged in the housing 10 such that they face apertures 11*a* formed at the front wall 11 of the housing 10, the apertures being arranged in two rows in the lateral direction and with equal distances therebetween. The other end of the contact 30 is formed as a pair of bifurcated legs 32,33, as best seen in FIG. 2 and as will be described later, and the ends of conductors 51 of two different flat cables 50 extending from other external electric circuits (not shown) are connected to respective legs 32,33. Among the conductors 51 shown in FIG. 1, conductors 51*a* are the ground conductors which are connected to the legs of the contacts engaged with the ground terminals of the external circuits, and the conductors 51b are the signal conductors which are connected with the legs of the contacts engaged with the signal terminals of the external circuits.

Figure 3:
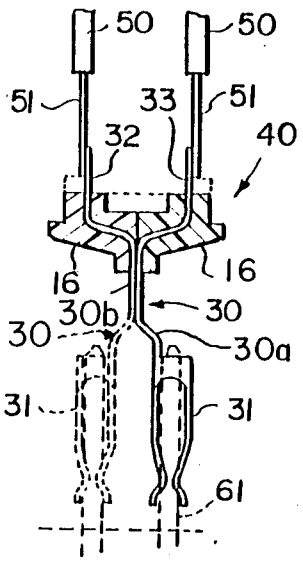
FIG. 3 is a front elevational view of a single contact as shown in FIG. 2.
Figure 2:
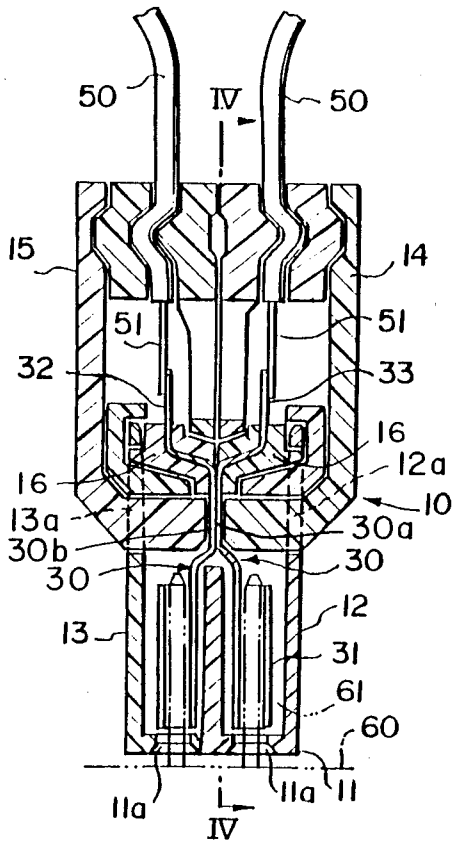
FIG. 2 is a cross-sectional view of the above-mentioned connector in FIG. 1 shown along the line 11—11 of FIG. 1.

As can be seen from FIGS. 2 and 3, the contact 30 includes a contact plate 30a having the receptacle 31 at one end and a leg 33 at the other end, and a short tab plate 30b having a leg 32 only, and is formed by welding the tab plate 30b to the contact plate 30a at the middle portion of the contact plate 30a.

The contact assembly is obtained by insert-molding a dielectric member 16 to a plurality of contacts which are arranged in an equally spaced relationship and in series. As indicated in FIG. 2, the receptacles 31 of the contacts 30 are arranged in housings 12,13 in alignment with the two rows of the apertures 11a and the bifurcated legs 32,33 of each contact 30 extend upward within housings 12,13. Conductors 51 of the different flat cables 50 are connected to the bifurcated legs 32,33 and cable portions close to the conductors are fixed by being clamped between housings 12,13 and the covers 14,15. Since the two legs 32,33 and the receptacle 31 of each contact 30 are formed integrally as mentioned above, each conductor 51 of the different flat cables 50 connected with legs 32,33 is electrically connected to the terminal 61 of a circuit board 60 when board 60 is engaged with the conductor 70. Thus a daisy chain connection with a pair of different flat cables 50 is formed by the single connector 70.

Figure 4:
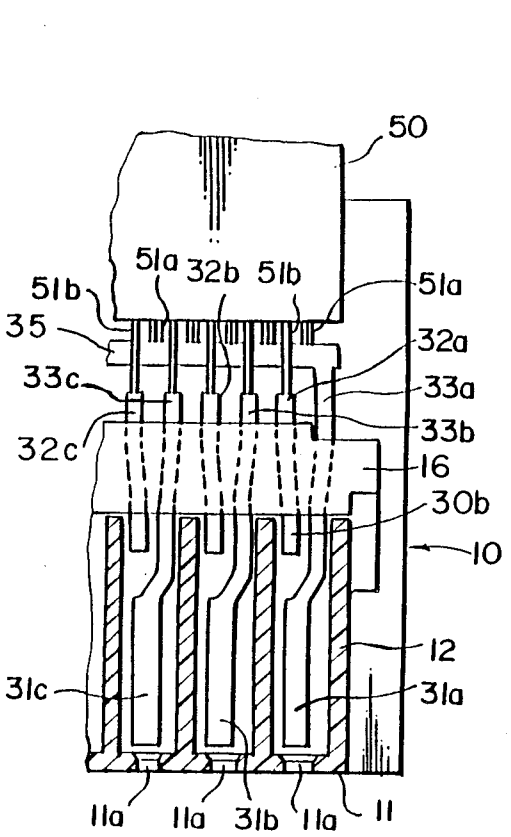
FIG. 4 is a cross-sectional view of the above-mentioned connector in FIG. 2, shown along the line IV—IV of FIG. 2.
Figure 5:
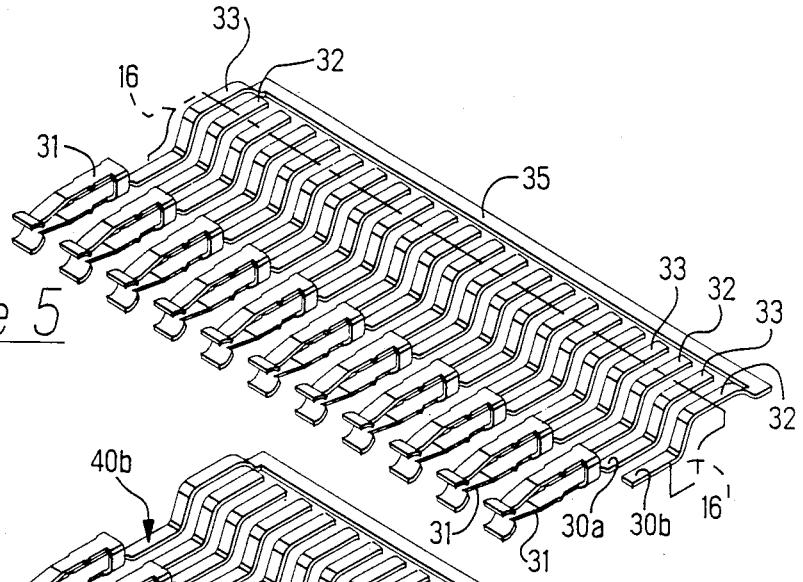
FIG. 5 to 7 are perspective views showing the order of assembly forming the contact assembly.

Next, the process of manufacturing the contact assembly will be described with reference to FIGS. 5 to 7. First, as shown in FIG. 5, a contact strip having the contact plates 30a, which include the receptacles 31 at one end and the legs 33 at the other end, and the tab plate 30b having the legs 32 only, arranged alternately, is formed from a sheet of metal by stamping and forming. It should be noted that the receptacle 31 of each contact plate 30a is formed at this stamping stage so that, as can be seen from FIG. 4, the receptacle 31 extends through the center line between the adjacent pair of legs 32 and 33. Next, dielectric member 16 shown with the double dotted line in FIG. 5 is insert molded to the contact strip and subsequently the signal contact plates and the signal tab plates are detached from the ground bar 35 whereby a contact sub-assembly 40a is formed. In FIG. 5, the left end contact plate and right end tab plate are used for the ground terminals, therefore, only the legs of the left end contact plate and the right end plate are connected with the ground bar 35, which is extended in the lateral direction at the rear end of the legs.

The contact sub-assembly will be further described with reference to FIG. 4. In FIG. 4, in order to simplify the description, each receptacle is denoted as 31a, 31b, 31c, . . . , and each leg as 32a, 32b, 32c. . . , and 33a, 33b, 33c. . . , commencing from the right. The contact plates 30a and the tab plates 30b formed by stamping which are of the same shape, respectively, are arranged alternately and held in position in the dielectric member 16. It should be noted that legs 32a, 33b, 32b, 33c, 32c are arranged to correspond to the conductors 51b of the cable 50 and that the receptacles 31a, 31b, 31c. . . , extending from the legs 33a, 33b, 33c. . . , are displaced at the middle portion of the contact plates such that the receptacles extend through a center line between each pair of legs 32a and 33a, 32b and 33b, 32c and 33c. . . , respectively, toward the apertures 11a of the housing 12.

Figure 6:
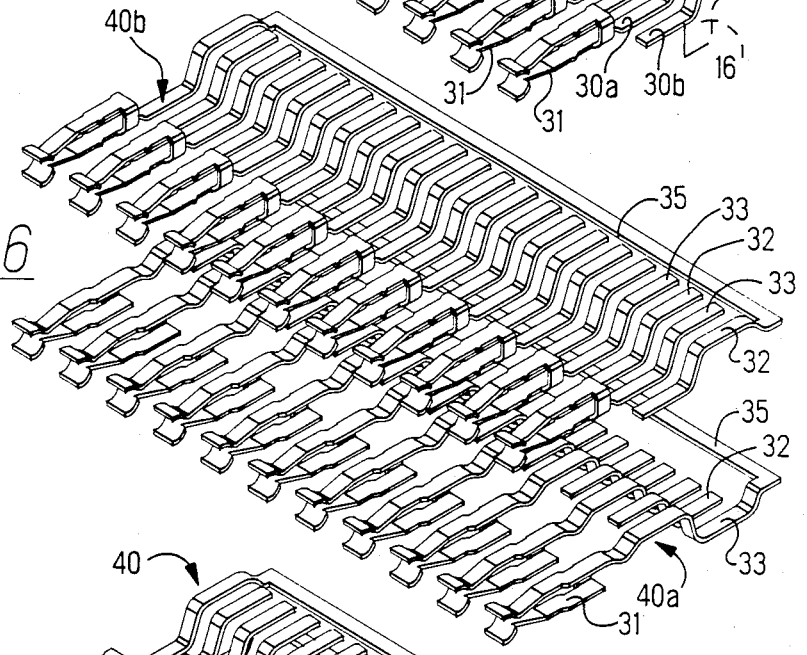
Figure 7:
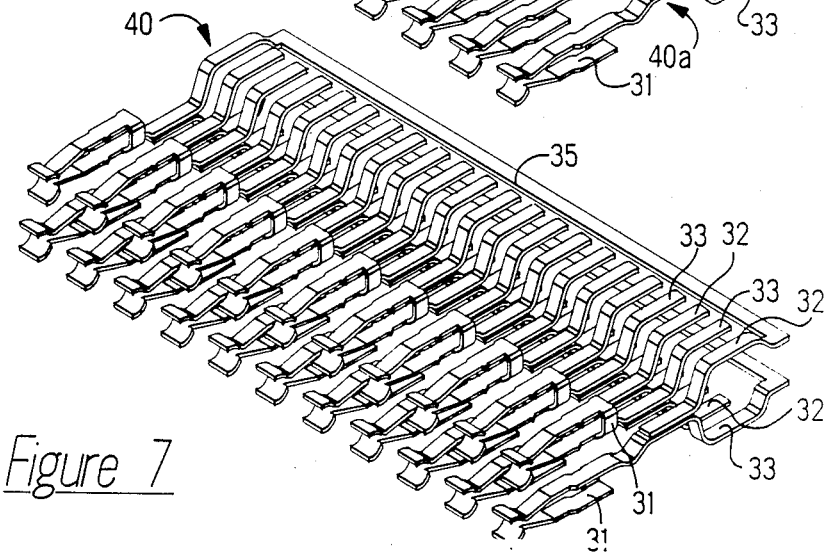
Figure 8:
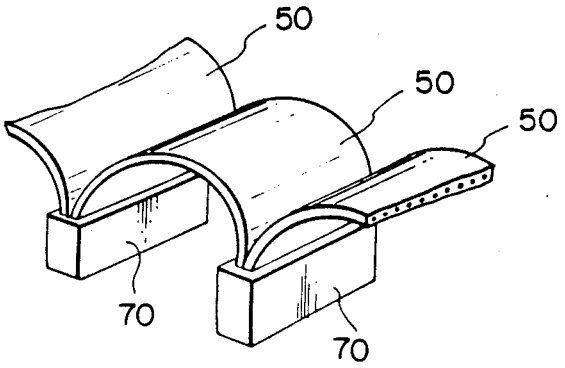
FIG. 8 is a perspective view of the flat cable formed in a daisy chain cable assembly by use of the connector of this invention.

Next, as shown in FIG. 6 (the dielectric member 16 is not shown), the two contact sub-assemblies 40a, 40b formed as described in FIG. 5 are arranged back-to-back so as to face in opposite directions, and as shown in FIG. 7 (the dielectric member 16 is not shown), the contact assembly is formed by welding sub-assemblies at the middle portions of the contact and tab plates 30a, 30b.

Figure 1:
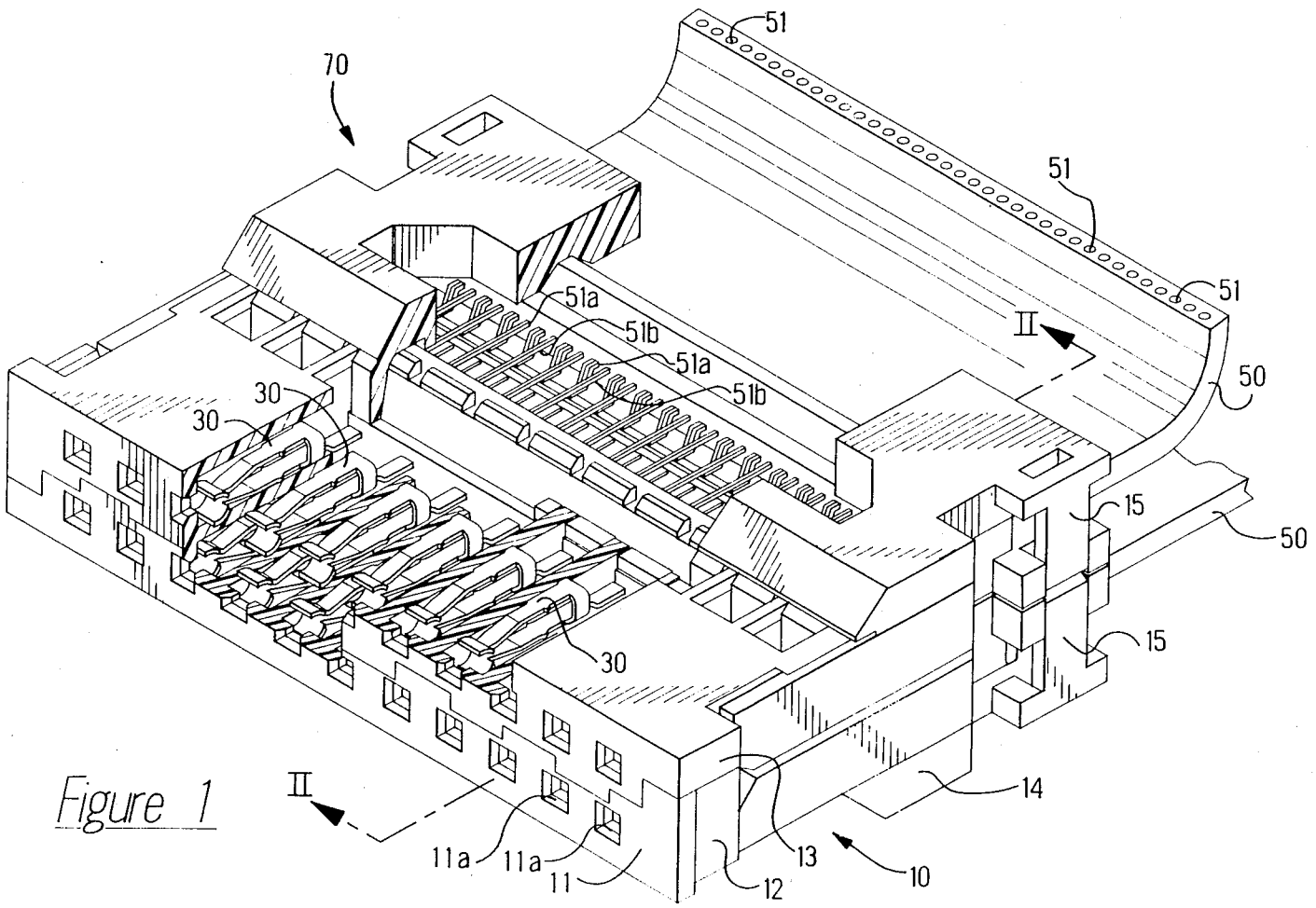
FIG. 1 is a perspective view of an example of the daisy chain connector of this invention.

In welding the sub-assemblies 40a, 40b, they are arranged such that the contact plate 30a and the tab plate 30b of one sub-assembly correspond to the tab plate 30b and the contact plate 30a of the other contact sub-assembly and that the receptacles 31 of both sub-assemblies be in parallel and equidistant from each other so that the receptacles 31 face the respective apertures 11a of the housing 10 when the sub-assemblies are mounted in the housing. The engaged contact plate 30a with the respective tab plates 30b are then welded together. Then the signal conductors 51b of the flat cable 50 are connected to the legs of the signal contact plates 30a and the signal tab plates of the contact assembly 40, except for the leg 33a which is part of the ground plate 35 and the ground conductors 51a of the flat cable are connected to the ground bar 35. These connections are preferably done by welding. After the connection of the conductors 51a, 51b of cables 50 to the contact assembly 40, the contact assembly is positioned in the housing 10 and thus the connector shown in FIG. 1 is assembled. In the above-mentioned embodiment, the welding for forming the contact assembly is made subsequent to the arrangement of the two contact sub-assemblies and before the connection of the flat cables, as shown in FIG. 7. However, the welding need not be conducted at this stage. Namely, the welding for the two contact sub-assemblies may be conducted through the apertures 12a, 13a of the housings 12,13 after the two connector assemblies connected to the flat cables 50 are assembled as shown in FIG. 2.

Thus, to formulate contact assembly 40 as shown in FIG. 7, identical stamped and formed contact sub-assemblies 40a, 40b have dielectric members 16 insert molded onto contacts 30 and legs 32 along legs 32,33 so that legs 32,33 to which signal conductors 51b are to be connected are separated from ground bars 35 except in the case of leg 33 remaining as part of ground bars 35. Dielectric members 16 maintain contacts 30 in position. Sub-assemblies 40a, 40b are positioned back-to-back as shown in FIG. 6 with dielectric members 16 in engagement as shown in FIG. 3 so that the tab plates 30a of legs 33 are positioned in overlying engagement with respective tab plates 30b of legs 32, whereafter the engaged tab plates 30a, 30b are secured together as by welding.

Figure 9:
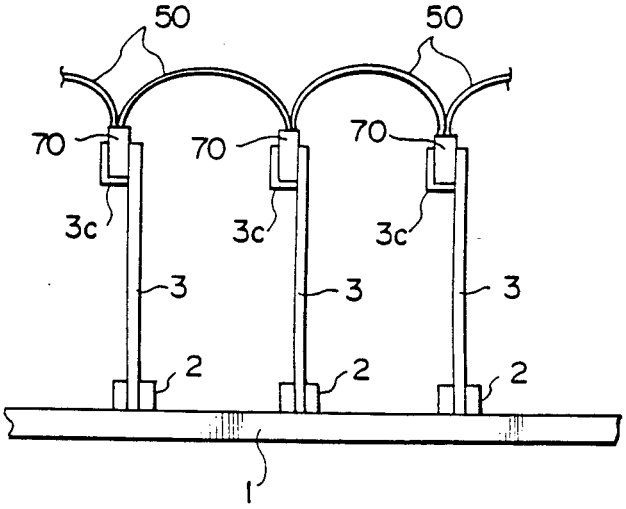
FIG. 9 is a front elevational view of an example of using the daisy chain cable assembly of FIG. 8 to connect the daughter boards to form a daisy chain connection therebetween.

FIG. 9 shows an example of the daisy chain connection in which a plurality of printed circuit boards are mutually connected by using the connector constructed according to the invention. A plurality of daughter boards 3 are connected to the mother board 1 through connectors 2 and the daughter boards 3 are connected to the connectors 70 through connectors 3C. The connectors 70 have flat cables 50 extending from and to the other connectors 70. Therefore, data signals transmitted through the flat cable 50 seen at the right end in FIG. 9 are sent to the daughter board 3 located at the right end on the mother board, and at the same time, to the other daughter boards 3 successively by the connectors 70 connecting the flat cables 50 together in a daisy chain.

In the above-mentioned embodiment, one of the bifurcated legs 32,33 of each contact 30 is connected to the conductor 51 of the flat cable 50 which is connected to the terminal of the second external electric circuit board and the other of the bifurcated legs 32,33 is connected to the conductor **51*b* of the flat cable connected to the terminal of the third external electric circuit boards, and, when the receptacles 31 are mated with the terminals 61 of board 60 of the first external electric circuit board, the first, second and third external circuit boards are electrically connected with each other through the contacts 30, whereby a daisy chain connection is established. However, in the arrangement shown in FIG. 9, where the cables 50 can be arranged such that the signal conductors connecting the daughter board 3 at the left end with the daughter board 3 at the center portion on the mother board, are not connected to the signal conductors connecting the daughter board 3 at the center portion with the daughter board 3 at the right end thereon. Such an arrangement according to the invention will be described with reference to FIGS. 10 and 11**.

Figure 10:
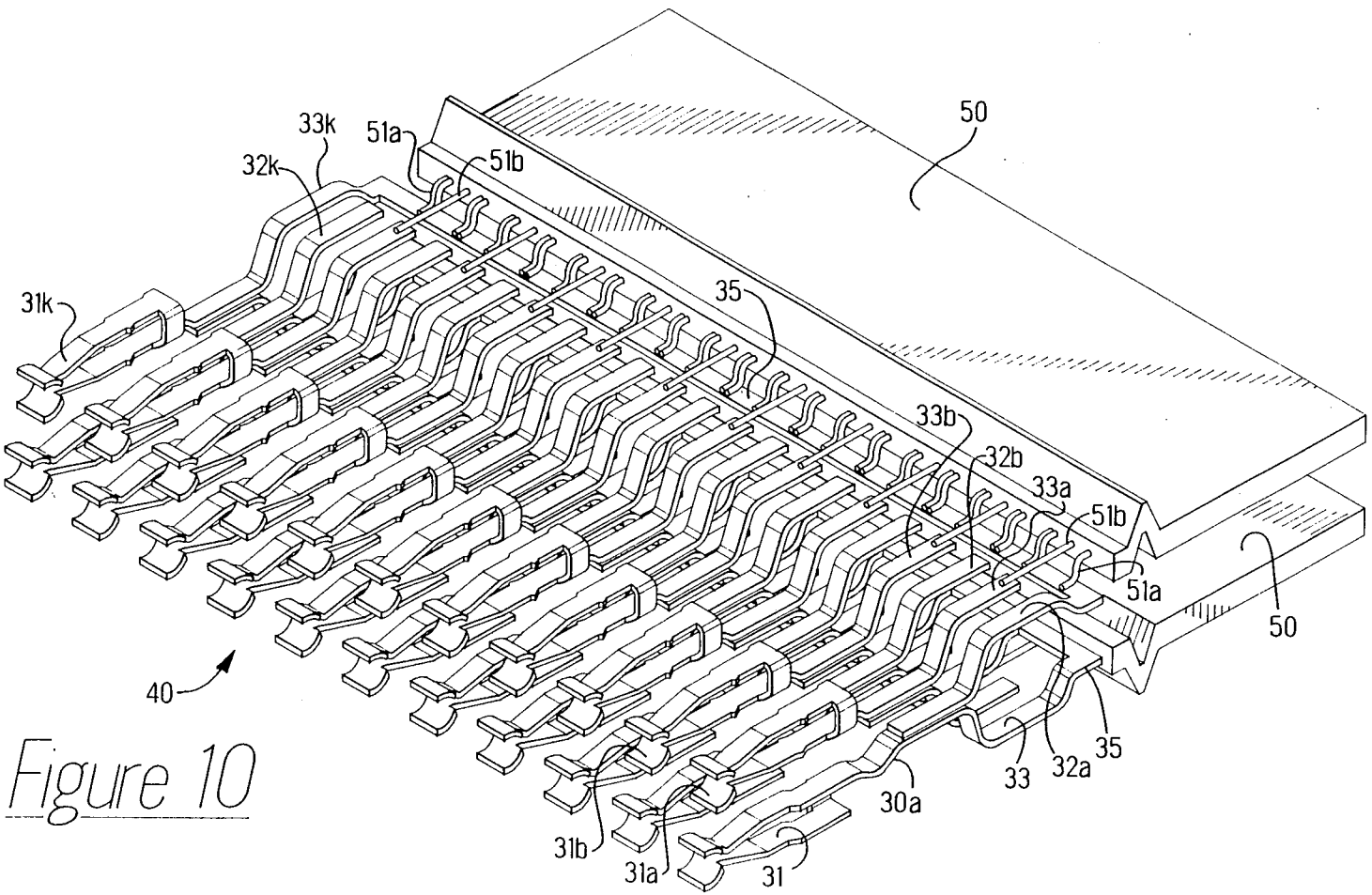
FIG. 10 is a perspective view of an alternative embodiment of the invention.

As shown in FIG. 10, the contact assembly is the same as that described in regard to the embodiment of FIGS. 1–7.

Figure 11:
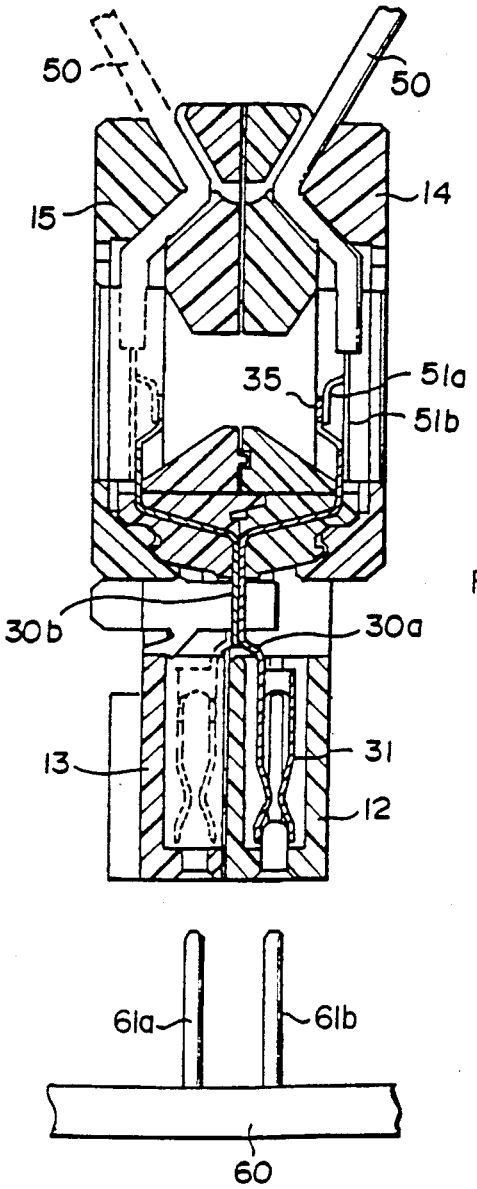
FIG. 11 is a cross-sectional view of the connector of FIG. 10.
Figure 12:
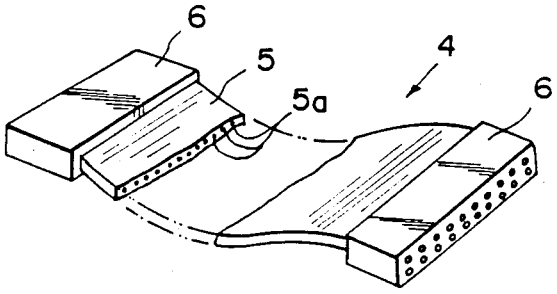
FIG. 12 is a perspective view of an example of connecting conventional connectors with flat cable forming a cable assembly.
Figure 13:
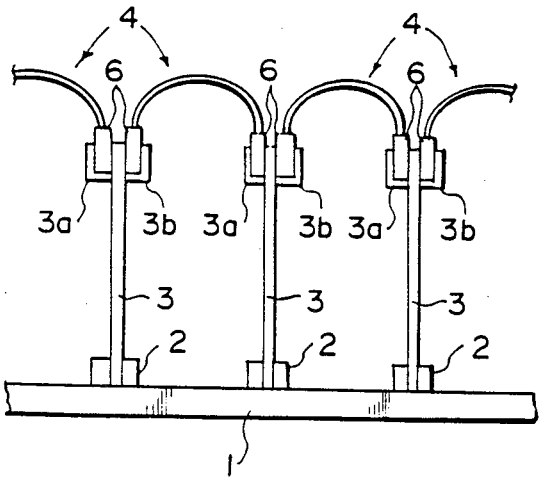
FIG. 13 is a front elevational view of an example where the cable assembly of FIG. 12 is used to form a daisy chain connection to connect daughter boards.

In FIG. 10, in order to simplify the description, each receptacle of the upper row is denoted as **31*a*, 31*b*, –31*k*, in successive order from the right, and each leg of the upper row of the bifurcated legs is denoted as 32*a*, 32*b*, –32*k* (which are the legs of the tab plates 30*b*) and 33*a*, 33*b*, –33*k* (which are the legs of the contact plates 30*a*), also in successive order from the right. The connection between the upper row legs and conductors 51*a*, 51*b* of the flat cable 50 of the upper side, will now be described with reference to FIG. 10. The ground conductors 51*a* are connected to the ground bar 35, which extends in the lateral direction, and the signal conductors 51*b* are connected to the respective legs 33*a*, 33*b*, –33*k* of the contact plates 30*a*, in successive order from the right. In this embodiment, the ground bar 35 is arranged to connect with legs 33*a* and 33*k* of the contact plates 30*a*, and thus the receptacles 31*a* and 31*k* are mated with the ground terminals 61 of the board 60, and the remaining receptacles 31*b*, 31*c*, –31*j* are connected to the signal terminals 61 of board 60 as shown in FIG. 11**. In this arrangement, the first external electric circuit may be comprised of two different circuits. In such a case, the upper row receptacles are connected to one of the circuits and the lower row receptacles to the other of the circuits.

Also, the signal conductors **51*b* of the lower side flat cable 50 are connected to the legs 33 of the contact plates 30*a* having the signal receptacles at the lower row and the ground conductors 51*a* are connected to the ground bar at the lower side of the contact. Namely, the flat cable 50 located at the upper side in FIG. 10 is connected to the terminals 61*a* on the board 60 through the upper-row receptacles 31, and the flat cable 50 located at the lower side is connected to the terminals 61*b* on the board 60 through the lower row receptacles 31. By the above-mentioned arrangement, the two cables 50 can be connected independently to the board 3 through the single connector 70** so that the daisy connection between the flat cables is not provided.

As explained above, according to the invention, the construction is such that a plurality of contacts are retained in the housing in two rows, each contact having at one end a first terminal which is engageable with the first external terminal of, for example, the first external circuit, and at the other end, a second terminal comprising bifurcated legs which are connected to the first and second cables which are connected to the second and third external circuits, respectively, and, thus, when the first terminal is connected to the first external terminal of the first external circuit, the first, second, and third external circuits are mutually and electrically connected so that a daisy chain connection is obtained. Also, by connecting the first cable to the bifurcated legs on one side of selected contacts among the plurality of contacts and the second cable to the bifurcated legs on the other side of the remaining contacts among the plurality of contacts, the first cable and the second cable can be connected independently to the third external circuit or two independent external circuits. Therefore, in the connection between the board defining the first external circuit, and two boards defining the second and third external circuits, for example, only a single connector need to be mounted on the board for the first external circuit, and thus a very small space for the connector on the board is needed. Therefore, a high density arrangement of various components on the board can be realized.

We claim:

1. An electrical daisy chain connector for electrically interconnecting first, second, and third circuit boards, said connector comprising, a dielectric housing, and rows of electrical contacts secured within said dielectric housing, each said electrical contact comprising first and second elements, said first element including a contact section at one end of said element in alignment with an aperture in a front surface of said housing, a first contact plate, and a first leg at another end of said element, said second element including a second contact plate and a second leg, said first and second contact plates being welded together so as to form each said electrical contact as an integral unit each having said contact section at one end and bifurcated first and second legs at another end thereof, said contact sections being connectable to conductors of said first circuit board, said first and second legs being connectable respectively to conductors of said second and third circuit boards via cable means.

2. An electrical daisy chain connector as claimed in claim 1, characterized in that dielectric members are secured to said legs maintaining said contacts in alignment.

3. The electrical daisy chain connector of claim 1 further comprising a ground bar, at least one leg of said rows of electrical contacts being connected to said ground bar.

4. The electrical daisy chain connector of claim 1 wherein each said contact section comprises a receptacle.

5. An electrical dais chain connector as claimed in claim 1, characterized in that said housing includes matable housing sections and cover sections.

6. An electrical daisy chain connector as claimed in claim 5, characterized in that said housing sections have openings in alignment with said engaged contact plates so that the contact plates can be welded together through said openings.

7. An electrical contact assembly for electrical connection to signal and ground conductors of a pair of discrete electrical cables, comprising:

a first row of electrical contacts having first contact sections, first plate sections and first bifrucated leg sections;

a second row of electrical contacts having second contact sections, second plate sections and second bifurcated leg sections;

said first and second bifurcated leg sections extending equal distances from respective first and second contact sections;

dielectric means secured to said electrical contacts so that the first contact sections and the second contact sections are parallel to each other with the first and second bifurcated leg sections extending in parallel rows so that the signal conductors of one of the electrical cables are electrically connectable to respective leg sections in one row of the first and second bifurcated leg sections while the signal conductors of the other of the electrical cables are electrically connectable to respective leg sections in the other row of the first and second bifurcated leg sections; and at least one of the leg sections in each row of the first and second bifurcated leg sections form a common ground bar to which the ground conductors of the electrical cables are directly electrically connectable.

8. An electrical contact assembly as claimed in claim 7, wherein the first and second rows of electrical contacts are disposed in a dielectric housing having apertures in a front end thereof with the contact sections being in alignment with respective apertures.

9. An electrical contact assembly as claimed in claim 8, wherein cover sections are mounted onto said housing and include strain relief means for engagement with the electrical cables.

10. An electrical contact assembly for electrical connection to signal and ground conductors of a pair of discrete electrical cables, comprising:

a first electrical contact sub-assembly includes alternating first contact members and first leg members, said first contact members having first contact sections, first contact plate sections and first contact leg sections, said first leg members having first leg plate sections and first leg member sections;

a second electrical contact sub-assembly includes alternating second contact members and second leg members, said second contact members having second contact sections, second contact plate sections and second contact leg sections, said second leg members having second leg plate sections and second leg member sections;

dielectric means secured to said first and second contact sub-assemblies positioning said first and second contact sections in parallel rows, said first contact plate sections in electrical engagement respectively with said second leg plate sections and said second contact plate sections in electrical engagement respectively with said first leg plate sections so that the respective said first contact leg sections and the second leg member sections define first bifurcated contact legs of said first contact member for electrical connection to respective signal conductors of the electrical cables and the respective said second contact leg sections and the first leg member sections define second bifurcated contact legs of said second contact members for electrical connection to respective signal conductors of the electrical cable; and at least one of the first and second bifurcated contacts being part of ground bar means for electrical connection to the ground conductors of the electrical cables.

11. An electrical contact assembly as claimed in claim 10, wherein the first and second rows of electrical contacts are disposed in a dielectric housing having apertures in a front end thereof with the contact sections being in alignment with respective apertures.

12. An electrical contact assembly as claimed in claim 11, wherein cover sections are mounted onto said housing and include strain relief means for engagement with the electrical cables.

13. A method of forming an electrical contact assembly from identical stamped and formed contact sub-assemblies each comprising alternate contact members and leg members, the contact members including contact sections, contact plates and leg sections, the leg members including further contact plates and further leg sections, at least one of the leg members is connected to a ground bar, characterized by the steps of:

placing the contact sub-assemblies back-to-back with the contact plates being in engagement with respective further contact plates; and welding the engaged contact plates so that each contact member has bifurcated leg sections.

14. A method as claimed in claim 13, characterized by the further step of molding a dielectric member to the leg sections so as to maintain the contact members and leg members uniformly spaced with respect to each other.

* * * * *

UNITED STATES PATENT AND TRADEMARK OFFICE

CERTIFICATE OF CORRECTION

PATENT NO. : 4,973,264

DATED : November 27, 1990

INVENTOR(S) : Takashi Kamono, et al

It is certified that error appears in the above-identified patent and that said Letters Patent is hereby corrected as shown below:

In the Claims:

Claim 5, line 63, Column 6, The word "dais" should be --daisy--.

Signed and Sealed this

Eighth Day of September, 1992

*Attest:*

DOUGLAS B. COMER

*Attesting Officer*

*Acting Commissioner of Patents and Trademarks*